US008584417B1

(12) United States Patent
Krieger

(10) Patent No.: US 8,584,417 B1
(45) Date of Patent: Nov. 19, 2013

(54) WALL PANEL SYSTEM

(75) Inventor: Kevin Krieger, New Philadelphia, OH (US)

(73) Assignee: Marlite, Inc., Dover, OH (US)

( * ) Notice: Subject to any disclaimer, the term of this patent is extended or adjusted under 35 U.S.C. 154(b) by 0 days.

(21) Appl. No.: 13/489,623

(22) Filed: Jun. 6, 2012

(51) Int. Cl.
*E04B 2/30* (2006.01)

(52) U.S. Cl.
USPC ..... 52/483.1

(58) Field of Classification Search
USPC ..... 52/483.1, 489.1, 489.2, 506.01, 474; D25/136
See application file for complete search history.

(56) References Cited

U.S. PATENT DOCUMENTS

| | | | | |
|---|---|---|---|---|
| D202,377 | S | 9/1965 | Broske et al. | |
| 3,712,015 | A | 1/1973 | Nelson | |
| 3,866,374 | A * | 2/1975 | Dallen | 52/204.597 |
| 4,504,555 | A | 3/1985 | Prior et al. | |
| 4,615,448 | A | 10/1986 | Johnstonbaugh | |
| 4,625,477 | A | 12/1986 | Johnstonbaugh | |
| 4,918,879 | A | 4/1990 | Bodurow et al. | |
| 4,937,992 | A | 7/1990 | Dawson et al. | |
| 5,030,045 | A | 7/1991 | Dawson et al. | |
| 5,138,803 | A | 8/1992 | Grossen | |
| 5,360,121 | A | 11/1994 | Sothman | |
| 5,377,470 | A * | 1/1995 | Hebinck | 52/405.1 |
| 5,398,468 | A | 3/1995 | Erickson | |
| 5,417,020 | A | 5/1995 | Dobija | |
| 5,484,067 | A | 1/1996 | Sothman | |
| 5,644,884 | A | 7/1997 | Dobija | |
| 5,694,727 | A | 12/1997 | Dobija | |
| D405,547 | S | 2/1999 | Dobija | |
| 5,881,522 | A | 3/1999 | Dobija | |
| D407,832 | S | 4/1999 | Dobija | |
| D408,558 | S | 4/1999 | Levy | |
| 5,918,437 | A | 7/1999 | Dobija | |
| D414,563 | S | 9/1999 | Dobija | |
| D425,215 | S | 5/2000 | Ginzel | |
| 6,202,377 | B1 | 3/2001 | Krieger | |
| 6,427,408 | B1 | 8/2002 | Krieger | |
| D464,153 | S | 10/2002 | Krieger | |
| 6,460,311 | B1 * | 10/2002 | Ito | 52/489.1 |
| D465,586 | S | 11/2002 | Krieger | |
| D466,233 | S | 11/2002 | Krieger | |
| D467,670 | S | 12/2002 | Krieger | |
| 6,491,172 | B2 | 12/2002 | Chance et al. | |
| D474,549 | S | 5/2003 | Krieger | |
| D477,423 | S | 7/2003 | Campbell et al. | |
| 6,588,165 | B1 * | 7/2003 | Wright | 52/506.05 |

(Continued)

FOREIGN PATENT DOCUMENTS

WO WO 2008094566 A2 * 8/2008

*Primary Examiner* — Mark Wendell
*Assistant Examiner* — Keith Minter
(74) *Attorney, Agent, or Firm* — Wegman, Hessler & Vanderburg

(57) ABSTRACT

A wall panel system that includes a plurality of rails positioned substantially parallel to each other, a plurality of panels wherein each panel extends between two adjacent rails, and a cross spline is positioned between each pair of panels and extending substantially perpendicular to adjacent rails is provided. The rails are attachable to a wall support structure. The rails receive the panels and maintain the panels in a spaced-apart relationship. Each panel includes a peripheral edge having a groove formed into the peripheral edge such that the groove is continuous and extends about the entire peripheral edge of the panel. Both the rails and the cross spline include a tongue that is insertable into the groove of each panel to allow the rails and cross splines to be in engagement with the panels.

7 Claims, 12 Drawing Sheets

(56) References Cited

U.S. PATENT DOCUMENTS

| | | | | |
|---|---|---|---|---|
| D479,008 | S | 8/2003 | Krieger | |
| D482,552 | S | 11/2003 | Campbell et al. | |
| D486,676 | S | 2/2004 | Campbell et al. | |
| 6,694,694 | B2 * | 2/2004 | Zeeff | 52/506.01 |
| D488,570 | S | 4/2004 | Houssian | |
| 6,772,890 | B2 | 8/2004 | Campbell et al. | |
| 6,792,727 | B2 | 9/2004 | Krieger | |
| D497,434 | S | 10/2004 | Brabeck | |
| 6,993,875 | B2 * | 2/2006 | Rudduck | 52/474 |
| 7,665,264 | B1 | 2/2010 | Wolfe | |
| D623,768 | S | 9/2010 | Antonic | |
| 7,908,807 | B2 * | 3/2011 | Geilen | 52/309.12 |
| 7,987,648 | B1 * | 8/2011 | Ryan | 52/506.06 |
| 8,006,458 | B1 | 8/2011 | Olofsson et al. | |
| 8,065,846 | B2 * | 11/2011 | McDonald et al. | 52/281 |
| 8,151,533 | B2 * | 4/2012 | Krieger | 52/489.1 |
| 8,151,539 | B2 * | 4/2012 | Grinsted | 52/745.1 |
| 8,161,705 | B2 * | 4/2012 | Pratt | 52/506.05 |
| 8,322,102 | B2 * | 12/2012 | Krieger | 52/489.1 |
| 2004/0049999 | A1 * | 3/2004 | Krieger | 52/245 |
| 2010/0050548 | A1 * | 3/2010 | Krieger | 52/270 |
| 2012/0167523 | A1 * | 7/2012 | Krieger | 52/775 |

* cited by examiner

WALL PANEL SYSTEM

FIELD OF THE INVENTION

The present invention relates to wall construction and, more particularly, to a wall system formed of an array of pre-finished panels held together in a modular system for creating a decorated or finished wall.

BACKGROUND OF THE INVENTION

It is well known to construct a wall surface for a room or other structure with a plurality of pre-fabricated panels that are positioned in rows and columns to cover the structure. Such constructions use decorative panels that typically include a wood or other type of decorative veneer with a solid core. In these wall systems, a plurality of rails are often attached to a wall to provide support for the system as well as a guide for the panels that attach to these rails. Typically, a plurality of brackets are attached to the rear surface of the panel by way of a mechanical fixing means such as a bolt or the like. Each bracket provides a gap between the bracket and the wall panel, wherein this gap is configured to receive the rail. The plurality of brackets are arranged such that they engage both an upper and lower rail. A plurality of panels are then arranged in an adjacent manner along each pair of rails to form a row of panels; and a plurality of rails are vertically spaced apart to create multiple rows of panels. A transverse aesthetic member is disposed between each pair of panels to separate the panels, and these transverse members can be aligned such that the panels are aligned in both rows and columns against the structure.

BRIEF SUMMARY OF THE INVENTION

In one aspect of the present invention, a wall panel system is provided. The wall panel system includes at least two rails, wherein the rails are aligned in a substantially parallel manner. The wall panel system also includes at least two panels, wherein each of the panels includes a front surface, a rear surface, a peripheral edge extending between the front and rear surfaces. Each of the two panels is positioned adjacent to another panel, and each of the panels extends between two rails that are positioned adjacent to each other. The wall panel system further includes at least one cross spline, wherein each cross spline is positioned between adjacent panels. The cross spline is oriented in a substantially normal manner relative to the adjacent rails. Each panel includes a continuous groove formed into the peripheral edge of the panel. The adjacent rails and the cross spline engage the groove.

In another aspect of the preset invention, a wall panel system is provided. The wall panel system includes a plurality of panels positioned adjacent to each other, wherein each of the panels includes a peripheral edge and a continuous groove formed into the entire peripheral edge. The wall panel system also includes a first rail operatively connected to a wall support structure, wherein at least a portion of the first rail is receivable within the groove of at least two panels positioned adjacent to each other. The wall panel system further includes a second rail operatively connected to the wall support structure and spaced apart from the first rail in a substantially parallel manner, wherein at least a portion of the second rail is receivable in the groove of the adjacent panels. The wall panel system also includes a cross spline oriented substantially perpendicular to the first and second rails, wherein at least a portion of the cross spline is receivable within the groove of the adjacent panels.

In yet another aspect of the present invention, a wall panel system is provided. The wall panel system includes a first panel having a core, a front surface attached to the core, a rear surface attached to the core, and a peripheral edge extending between the front and rear surfaces, wherein a continuous groove is formed into the peripheral edge. The wall panel system also includes a second panel positioned adjacent to the first panel. The second panel has a core, a front surface attached to the core, a rear surface attached to the core, and a peripheral edge extending between the front and rear surfaces, wherein a continuous groove is formed into the peripheral edge. A first rail engages the groove formed into the first panel and the groove formed into the second panel. A second rail is positioned adjacent to the first rail, wherein the first and second panels extend between the first rail and the second rail, and the second rail engages the groove formed into the first panel and the groove formed into the second panel. A cross spline is positioned between the first panel and the second panel, wherein the cross spline engages the groove formed into the first panel and the groove formed into the second panel.

Advantages of the present invention will become more apparent to those skilled in the art from the following description of the embodiments of the invention which have been shown and described by way of illustration. As will be realized, the invention is capable of other and different embodiments, and its details are capable of modification in various respects.

BRIEF DESCRIPTION OF SEVERAL VIEWS OF THE DRAWINGS

These and other features of the present invention, and their advantages, are illustrated specifically in embodiments of the invention now to be described, by way of example, with reference to the accompanying diagrammatic drawings, in which.

Figure 1:
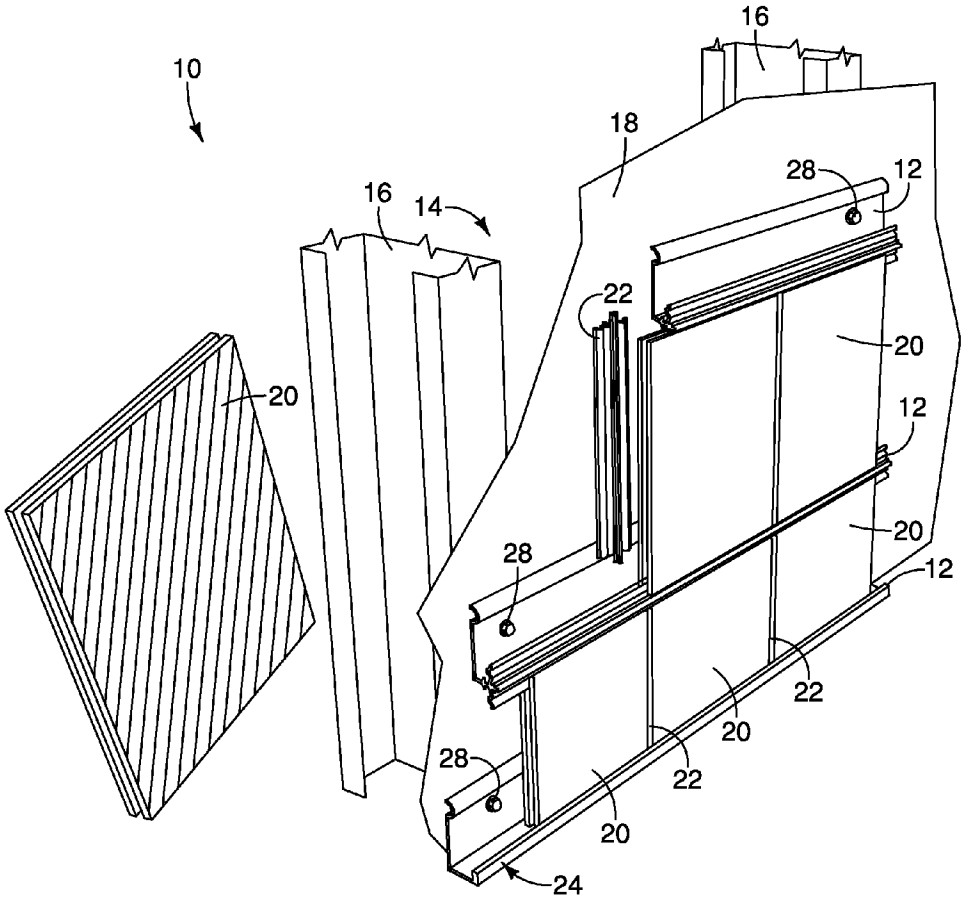
FIG. 1 is a perspective view of an embodiment of a wall panel system.

It should be noted that all the drawings are diagrammatic and not drawn to scale. Relative dimensions and proportions of parts of these figures have been shown exaggerated or reduced in size for the sake of clarity and convenience in the drawings. The same reference numbers are generally used to refer to corresponding or similar features in the different embodiments. Accordingly, the drawing(s) and description are to be regarded as illustrative in nature and not as restrictive.

DETAILED DESCRIPTION OF THE PREFERRED EMBODIMENT

Referring to FIG. 1, an exemplary embodiment of a wall panel system 10 is shown. The wall panel system is designed to allow for easy installation of a durable wall in a variety of different locations. The wall panel system 10 can be used to cover a full wall, a portion of a wall, or the system may be used as wainscoting to cover a portion of a wall. The wall panel system 10 provides a finished look using a modular system which can be easily replaced or updated with a new or more modern appearance. For example, the wall panel system 10 may be used to provide a decorated or finished looking wall in terminal corridors at airports, public areas or in locker rooms at sport arenas, classrooms or meeting areas at universities, grocery or other stores, a waiting room in a doctor's office, the support wall under a bar countertop, and the like.

In an embodiment, illustrated in FIG. 1, the wall panel system 10 includes a plurality of rails 12 oriented substantially horizontally in a spaced-apart manner and fixedly attached to a wall support structure 14. The wall support structure 14 may be formed of a plurality of wall studs 16 having drywall 18 or other covering layer attached to the studs 16. It should be understood by one of ordinary skill in the art that the wall support structure 14 can be any form of supporting structure sufficient to allow the wall panel system 10 to be securely mounted thereon, which includes various locations for which the wall panel system 10 may be used. A plurality of panels 20 are operatively attached to the horizontally-aligned rails 12 in a releasably locking manner. Vertically-aligned cross splines 22 are disposed between adjacent panels 20 to provide both a physical as well as a visual division between panels 20. The rails 12, panels 20, and cross splines 22 are pieced together to provide a finished appearance for a wall.

Figure 2A:
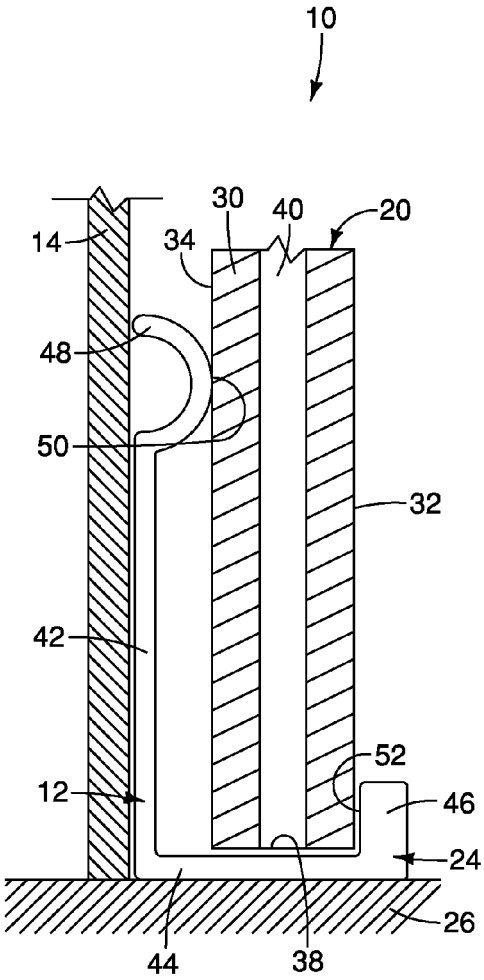
FIG. 2A is a magnified cross-sectional view of a portion of the wall panel system shown in FIG. 1.
Figure 2B:
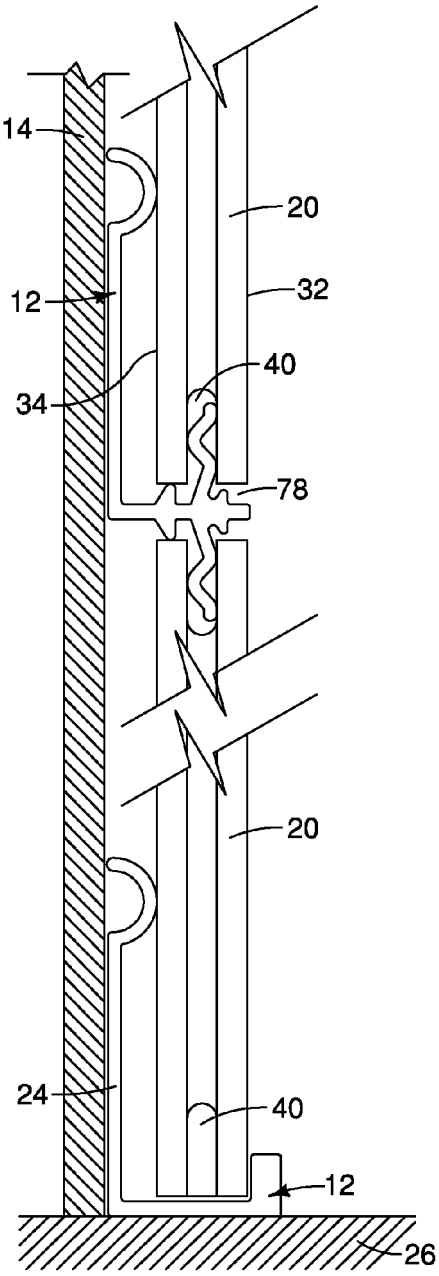
FIG. 2B is a magnified cross-sectional view of a portion of the wall panel system shown in FIG. 1.

FIGS. 2A-2B illustrate an exemplary embodiment of an edge rail 24, which is one embodiment of a horizontally-aligned rail 12. The edge rail 24 can be positionable along the floor 26, ceiling (not shown), or side edge of the finished wall panel system 10. The edge rail 24 is configured to provide a clean-looking boundary edge, as illustrated in FIG. 1. As shown in FIG. 2A, the edge rail 24 can be disposed at the junction between the support structure 14 and the floor 26, and the edge rail 24 is secured to the support structure 14 by way of a plurality of bolts 28 (FIG. 1) or other attachment means sufficient to fixedly attach the edge rail 24 to the support structure 14. When positioned adjacent to the floor 26, the edge rail 24 is configured to extend horizontally along substantially the entire length of the support structure 14, thereby providing a lower structural member configured to receive the first horizontally-aligned row of panels 20. Alternatively, multiple edge rails 24 can be placed end-to-end to extend along the entire length of the support structure 14, or a portion of the length thereof. When the edge rail 24 is positioned in a vertical manner either along a transition between two walls or at the terminal end of a wall, the edge rail 24 is configured to extend at least a portion of the height of the support structure 14 to provide a lateral end cap to at least one row of panels 20.

The edge rail 24 is configured to provide a cap or an aesthetic boundary to the edges of a wall panel system 10 as well as aligning the first row of panels 20. At least one horizontally-aligned rail 12 is securable to the wall support structure 14 in a spaced-apart and parallel manner relative to the edge rail 24, as shown in FIG. 1. These spaced-apart rails 12 are configured to provide substantially horizontal alignment and support for the second and each successive row of panels 20 adjacent to the first row. As shown in FIGS. 1 and 2B, the rail 12 is positioned adjacent to the support structure 14 and is secured to the wall support structure 14 by way of a plurality of bolts 28. The rails 12 are spaced in the vertical direction a distance sufficient to allow the entire row of panels 20 to be operatively connected to a pair of opposing rails 12 that are configured to engage the upper and lower edges of the panels 20. Each adjacent horizontally-aligned row of panels 20 is separated by a rail 12 positioned therebetween. In an embodiment, both the uppermost and lowermost horizontally-aligned rows of panels 20 are bounded by an edge rail 24.

As the panels 20 are positioned along the horizontal row, a vertically-aligned cross spline 22 is positioned between each adjacent panel 20, as shown in FIG. 1. The cross splines 22 are configured to engage a vertical edge of each adjacent panel to provide a vertical differentiation between the panels. As successive horizontal rows of panels 20 are installed, the cross splines 22 should be substantially aligned such that they provide the appearance of a single vertical cross spline. The cross splines 22 are configured to extend in a substantially perpendicular manner relative to the horizontally-aligned rails 12, and each cross spline 22 extends between adjacent rails 12 such that the height of the cross spline 22 is approximately the length of the vertical edge of the panel 20 to which the cross spline 22 engages. The rails 12 and cross splines 22 provide the skeletal framework for the panels 20 in the wall panel system 10.

Figure 3B:
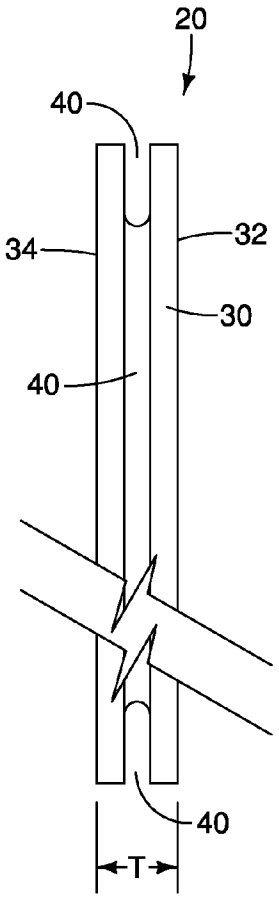
FIG. 3B is a side view of the panel shown in FIG. 3A.
Figure 3A:
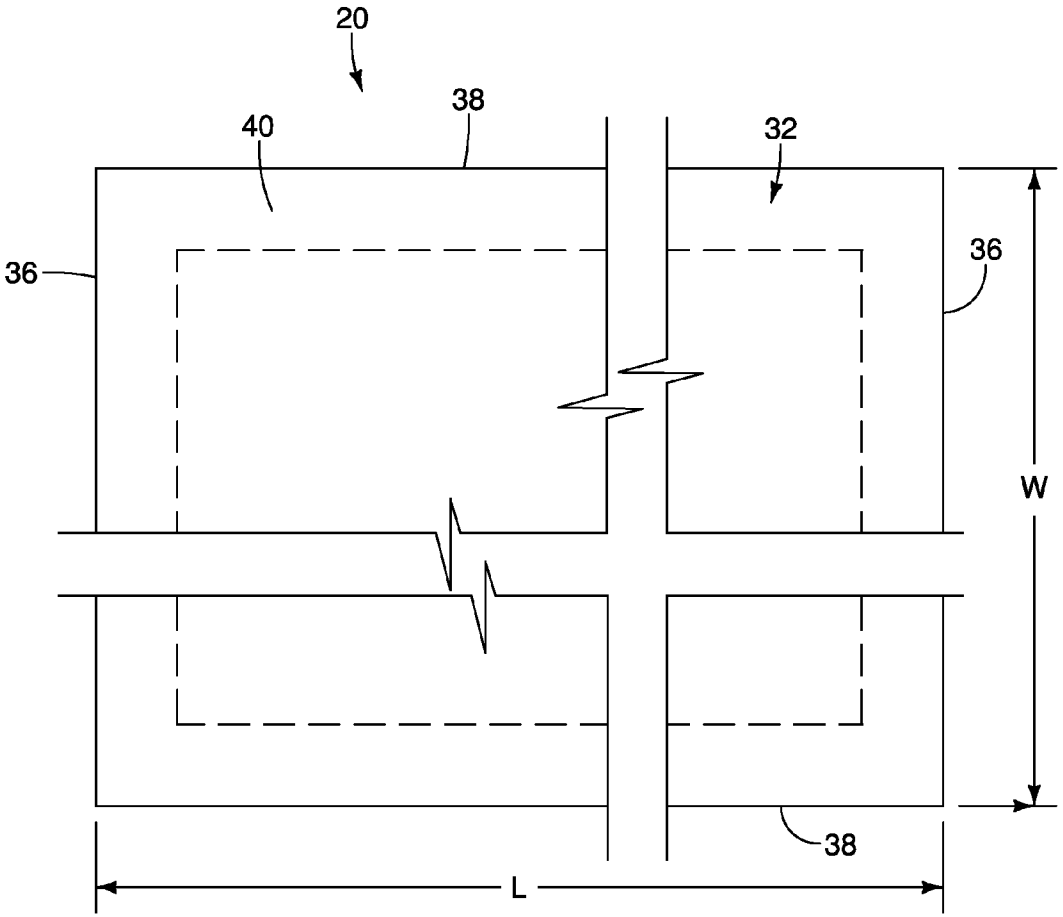
FIG. 3A is a plan view of a panel.

FIGS. 3A-3B illustrate an exemplary embodiment of a panel 20 for use in the wall panel system 10. The panel 20 includes a core 30 having a front surface 32 and an opposing rear surface 34, wherein the core 30 is sandwiched between the front and rear surfaces 32, 34. In an embodiment, the core 30 is formed of plywood, fiber-reinforced plastic (FRP), cement board, sheet rock or any other material that provides a reinforced center for the panel 20. The front surface 32 of the panel 20 may be formed of a decorative layer or any other type of layer that provides an aesthetic appearance of the panel 20. In an embodiment, the rear surface 34 is formed of the same material as the front surface 32 such that the panel 20 is substantially reversible in case either the front or rear surface 32, 34 becomes damaged. In another embodiment, the rear surface 34 is formed of a different material than the front surface 32. It should be understood by one of ordinary skill in the art that the panel 20 may be formed of any number of layers, and the 3-layer panel 20 described above is for illustrative purposes only.

In an exemplary embodiment, as shown in FIGS. 3A-3B, each panel 20 has a substantially square or rectangular shape. The panel 20 includes a pair of opposing vertical edges 36 and a pair of horizontal edges 38 that extend between the vertical edges 36. The vertical and horizontal edges 36, 38 of the panel 20 extend between the front and rear surfaces 32, 24 to form a thickness T. The distance between opposing vertical edges 36 provides the width W of the panel, and the distance between the opposing horizontal edges 38 provides the height H of the panel. It should be understood by one of ordinary skill in the art that the dimensions of the panel 20 may vary and depend upon the materials used for the panel, the physical properties of the panel, or the location or purpose for which the panel will be used, among other factors. The peripheral edge of the panel 20 is a combination of each of the individual side edges or lateral edges that extend between the front and rear surfaces 32, 34 of the panel 20. Although the terms "horizontal" and "vertical" are used to describe the components of the peripheral edge of the panel 20, these terms are only used as references with respect to the adjacent edges and to differentiate between the adjacent edges and should not be interpreted as an absolute direction or orientation of the particular edge.

Each panel 20 includes a kerf, or groove 40, formed into each of the vertical and horizontal edges 36, 38, as shown in FIGS. 3A-3B, to form a continuous groove about the entire peripheral edge of the panel 20. Each groove 40 is formed into a peripheral edge of the panel 20 between the front and rear surface 32, 34 and extends into the thickness of the panel 20 from the peripheral edge thereof. The groove 40 extends from each edge toward the center of the panel 20. Grooves 40 formed along adjacent edges intersect each other to form a continuous groove around the entire peripheral edge of the panel 20, as illustrated in dashed lines in FIG. 3A. In an embodiment, the groove 40 is a U-shaped groove having a rounded interior edge. In another embodiment, the groove 40 is a square groove in which the interior edge is substantially perpendicular to the side walls of the groove. It should be understood by one of ordinary skill in the art that the grooves 40 can have any shape sufficient to receive a portion of a rail 12 or cross spline 22 for providing a tongue-and-groove-type engagement between the rail 12 or cross spline 22 and the panel 22, as will be explained in more detail below. It should also be understood by one of ordinary skill in the art that the depth of the groove 40 should be sufficient to receive a portion of a rail 12 or cross spline 22. The panels 20 are positioned between rails 12 and the cross splines 22 such that each panel 20 engages opposing cross splines 22 and rails 12 in a tongue-and-groove attachment means.

FIGS. 1, 2A-2B, and 4A-4B illustrate an exemplary embodiment of an edge rail 24 for use in the wall panel system 10. The illustrated edge rail 24 includes an elongated base 42, a cap 44 extending from one end of the base 42, a cover 46 extending from the cap 44, and a buffer 48 extending from the opposing end of the base 42 relative to the cap 44. The base 42 is an elongated, substantially straight member that is configured to be positioned adjacent to a support structure 14 such as a wall or the like. The base 42 can be fixedly attached, removably attached, or simply abutting the support structure 14 (FIG. 1). In an embodiment, the base 42 of the edge rail 24 is fixedly attached to wall support structure 14 by a plurality of bolts 28. However, it should be understood by one of ordinary skill in the art that the edge rail 24 can also be removably attached to the wall support structure 14. It should also be understood by one of ordinary skill in the art that any mechanical fastener can be used to attach the edge rail 24 to the wall support structure 14.

The buffer 48 of the edge rail 24 extends from a distal end of the base 42 and, as shown in FIGS. 1, 2A-2B, and 4A-4B. In the illustrated embodiment, the buffer 48 is shown as contacting the rear surface of the panel 20, but it should be understood by one of ordinary skill in the art that the buffer 48 may also be spaced apart from the panel 20, particularly due to the differences in thickness of the panels 20 that can be used with the wall panel system 10. The buffer 48 is configured to provide and allow the panels 20 that are supported thereby to be spaced from the support structure 14 the same distance as the adjacent row of panels 20. In an embodiment, the buffer 48 has a semi-circular cross-sectional shape. In another embodiment, the buffer 48 has a square-like cross-sectional shape. It should be understood by one of ordinary skill in the art that the buffer 48 may have any cross-sectional shape sufficient to provide a similar spacing between the panels 20 and the support structure 14. When installed, the buffer 48 extends away from the support structure 14 to provide a first contact surface 50 against which the panel 20 can abut when installed. The first contact surface 50 can maintain the panel 20 in a spaced-apart relationship relative to the support structure 14 if the first contact surface 50 is abutting the panel 20.

Figure 4B:
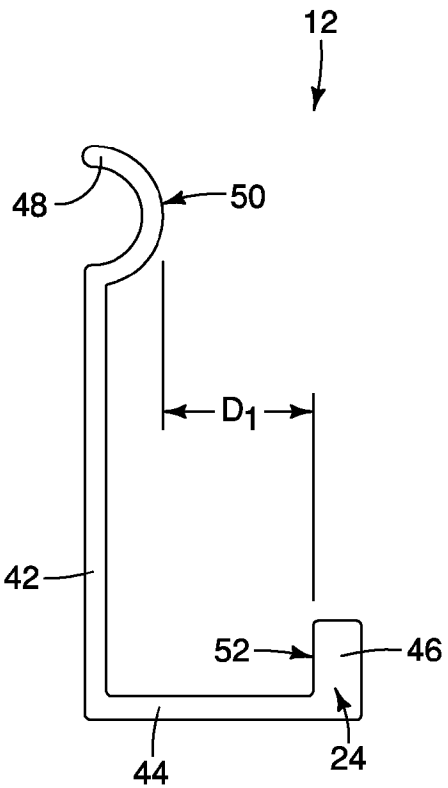
FIG. 4B is a cross-sectional view of the edge rail shown in FIG. 4A.

The cap 44 of the edge rail 24 extends from the opposing distal end of the base 42 with respect to the buffer 48, as shown in FIG. 4B. The cap 44 extends from the base 42 in a substantially planar and perpendicular manner, thereby forming an L-shaped cross-section therebetween. The cap 44 is configured to be positioned immediately adjacent to a horizontal edge 38 of a panel 20 (FIG. 2A) received by the edge rail 24. The cap 44 extends between the base 42 and the cover 46. When the edge rail 24 is installed along a wall support structure 14, the cap 44 is spaced apart from the wall support structure 14 and is positioned immediately adjacent to the floor 26. In an embodiment, the cap 44 is fixedly attached to the floor 26. In another embodiment the cap 44 is in an abutting relationship with the floor 26 without being attached thereto. When the edge rail 24 is installed vertically at the terminal end of a wall or horizontally at a location spaced from the ceiling or top surface of the support structure 14, the cap 44 is directed outwardly and exposed. When the edge rail 24 is installed along the base of a wall support structure 14 along the floor 26 or the ceiling, the cap 44 is hidden by the panel 20.

The distance that the cap 44 extends between the base 42 and the cover 46 should be slightly larger than the thickness of the panel 20 received by the edge rail 24, as shown in FIGS. 2A-2B. The cover 46 extends from the end of the cap 44 opposite the end of the cap 44 attached to the base 42. The cover 46 is oriented in a substantially parallel manner relative to the base 42, wherein the base 42, cap 44, and cover 46 together form a generally U-shaped cross-section. The surface of the cover 46 directed toward the base 42, or the second contact surface 52, is spaced apart from the plane formed by the first contact surface 36 of the buffer 48 by a first distance $D_1$, wherein the first distance $D_1$ is substantially equivalent to the thickness of the panel 20 received by the edge rail 24. When the edge rail 24 is installed, the cover 46 is positioned immediately adjacent to the outward-directed surface of the panel 20 received by the edge rail 24. The first contact surface 50 contacts the rear surface 34 of the panel 20 and the second contact surface 52 contacts the front surface 32 of the panel 20 to stabilize the lower portion of the panel 20 in a cantilever-like manner.

Figure 4A:
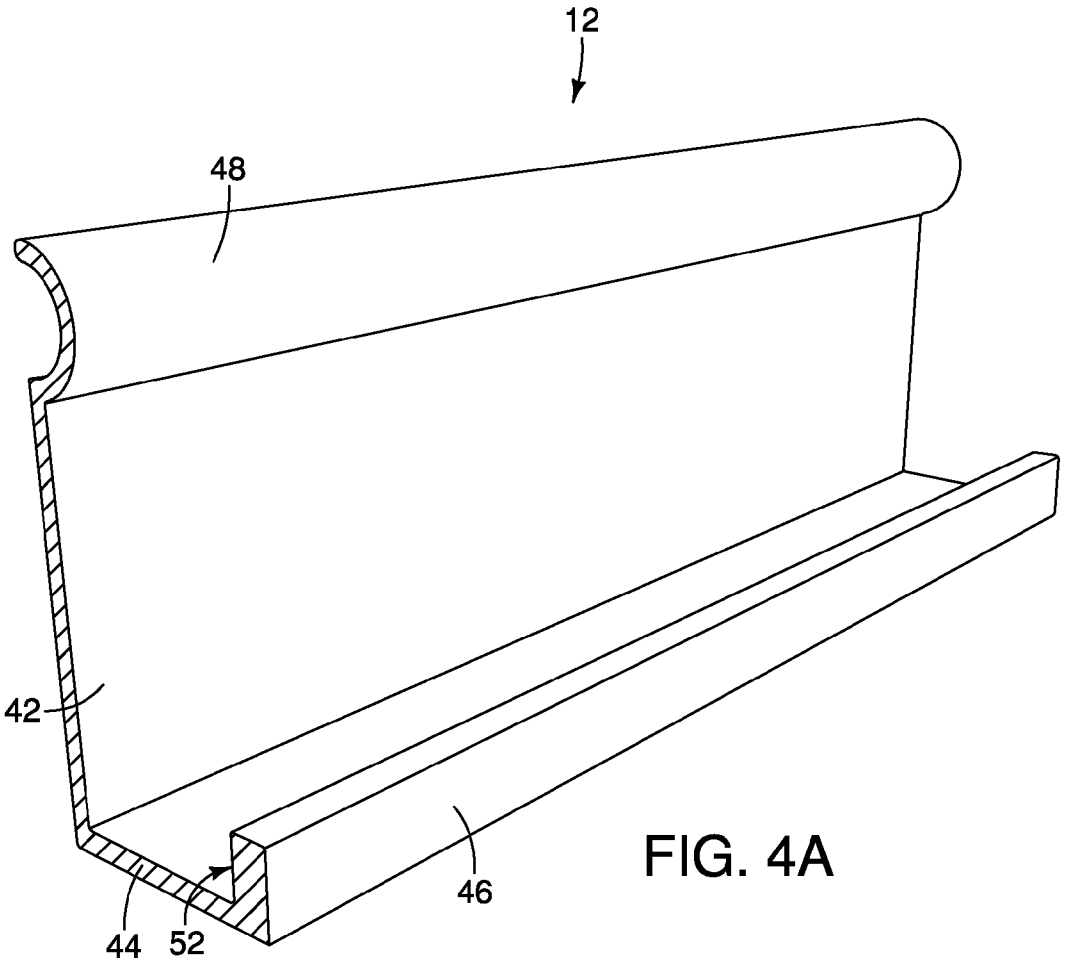
FIG. 4A is a perspective view of an embodiment of an edge rail.

The edge rail 24 illustrated in FIGS. 4A-4B can be formed of aluminum, steel, plastic, polymer, metal, or any material sufficient to provide a clean yet durable edge to the wall panel system 10. In an embodiment, the edge rail 24 is formed of an aluminum sheet that is pressed or extruded to generate the desired cross-sectional shape. The length of the edge rail 24 can be between about one inch (1 in.) and about twenty feet (20 ft.) or more. The thickness of each portion of the edge rail 24 can be substantially uniform, or as shown in the exemplary embodiment of FIGS. 4A-4B, portions such as the cover 46 can have a larger or different thickness than other portions of the edge rail 24. In an embodiment, the thickness of the edge rail is between about one-tenth of an inch (0.10 in.) and about four-tenths of an inch (0.40 in). In an embodiment, the first distance $D_1$ is about 0.127 inches. Although these are exemplary measurements, it should be understood by one of ordinary skill in the art that the measurements of the edge rail 24 can be any distance sufficient to provide a foundation or edge of a wall panel system 10 and receive at least one panel 20. The edge rail 24 is typically positioned at the top and/or bottom of a wall support structure 14 and typically forms the upper and/or lower boundaries of the wall panel system 10, whereas the rails 12 and the cross splines 22 provide the interior structure supports for the wall panel system 10.

Figure 5A:
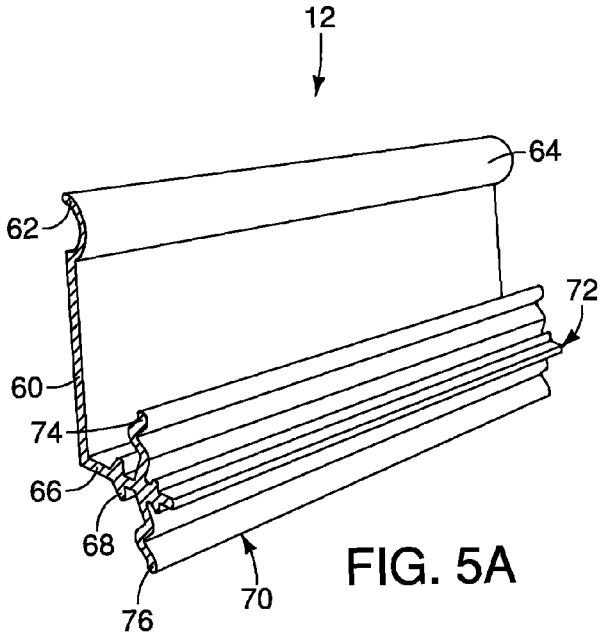
FIG. 5A is a perspective view of the rail shown in FIG. 1.
Figure 5C:
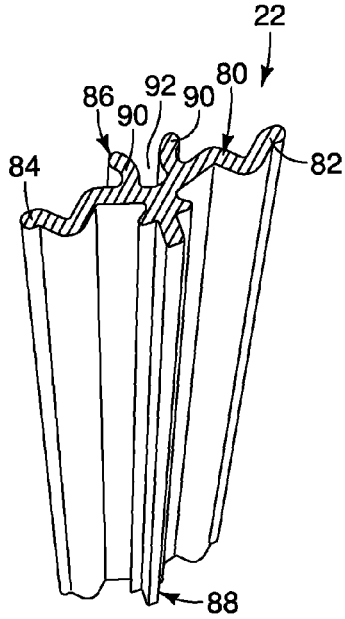
FIG. 5C is a perspective view of the cross spline shown in FIG. 1.
Figure 5B:
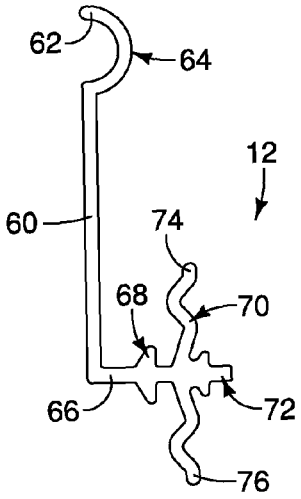
FIG. 5B is a cross-sectional view of the rail shown in FIG. 5A.

FIGS. 1 and 5A-5D illustrate one embodiment of a portion of a wall panel system 10. The illustrated wall panel system 10 includes an edge rail 24, a plurality of horizontally-aligned rails 12 secured to a wall support structure 14 by way of bolts 28, a plurality of vertically-aligned cross splines 22, and a plurality of panels 20 positioned between and engaged with the rails 12 and cross splines 22. FIGS. 5A-5B illustrate an embodiment of a rail 12, wherein the rail 12 are elongated members having a base 60 that is a substantially planar portion that is configured to be positioned immediately adjacent to a wall support structure 14 in an abutting manner. Bolts 28 can be used to fixedly attach the rails 12 to the wall support structure 14, wherein the bolts 28 pass through the thickness of the base 60.

The embodiment of the rail 12 shown in FIGS. 1 and 5A-5B also includes a buffer 62 extending from a distal end of the base 60. The buffer 62 is configured to contact or abut the rearward-facing surface of a panel 20 received by the rail 12 so as to provide a gap between the rear surface 34 (FIG. 3B) of the panel 20 and the wall support structure 14. In the illustrated embodiment, the buffer 62 has a semi-circular cross-sectional shape. In another embodiment, the buffer 62 has a square-like cross-sectional shape. It should be understood by one of ordinary skill in the art that the buffer 62 may have any cross-sectional shape sufficient to contact the panel 20 to maintain at least a portion of the panel in a spaced-apart relationship relative to the wall support structure 14. When installed, the buffer 62 extends away from the wall support structure 14 to provide a first contact surface 64 against which the panel 20 abuts when installed, wherein the first contact surface 64 thus maintains the panel 20 in a spaced-apart relationship relative to the support structure 14.

An arm 66 extends from the opposing distal end of the base 60 of the rail 12 with respect to the buffer 62, as shown in FIGS. 5A-5B. The arm 66 is oriented substantially perpendicular with respect to the base 60. The arm 66 extends the length of the rail 12 and provides support for a panel 20 positioned above the arm 66 as well as engaging the panel 20 positioned below the arm 66 when the rail 12 is installed in a substantially horizontal manner. The arm 66 includes a support member 68, a tongue 70, and a decorative member 72 extending therefrom. The support member 68 extends in opposing directions from the arm 66 in a substantially perpendicular manner. In an embodiment, the support member 68 is formed as opposing nubs or protrusions. Each of these protrusions of the support member 68 is configured to contact an adjacent panel 20. The support member 68 is configured to maintain the adjacent panels 20 in a spaced-apart relationship relative to each other as well as the arm 66 of the rail 12. The support member 68 provides an aesthetic, but visible gap 78 (FIG. 2B) between horizontally adjacent panels 20. The support member 68 is positioned adjacent to, but spaced apart from, the intersection between the arm 66 and the base 60.

In an embodiment, the tongue 70 is located along the arm 66 adjacent to the first support member 68 but laterally outward relative to the intersection between the arm 66 and the base 60, as shown in FIGS. 5A-5B. The tongue 70 extends in opposing directions from the arm 66 to provide a first securing member 74 and a second securing member 76. The first and second securing members 74, 76 extending from the arm 66 in a manner such that they are generally aligned and spaced apart from the base 60. In an embodiment, the first and second securing members 74, 76 are linear projections extending in opposing directions from the arm 66. In another embodiment, the first and second securing member 74, 76 project from the arm 66 in a non-linear manner, wherein the first and second securing members 74, 76 each include at least one bend or curve along the length as they extend from the arm 66. The first and second securing members 74, 76 are configured to be received within the groove 40 of adjacent panels 20, and the bend or curve in the first and second securing members 74, 76 is configured to ensure that the respective securing member contacts both opposing side walls of the groove 40. The non-linear shape of the first and second securing members 74, 76 provides opposing contact surfaces on each securing member to contact both side walls of a groove without having to have a precise thickness to ensure contact with both side walls. Accordingly, the manufacturing tolerances of the grooves 40 in the panels 20 as well as the thickness of the securing members 74, 76 need not be so exacting due to the inherent flexing that the non-linear securing members 74, 76 provide. The non-linear shape and flexibility of the first and second securing members 74, 76 also act similar to an outwardly-biasing spring to positively contact and grip the opposing side walls of the groove 40 into which each is disposed. In an embodiment, the first and second securing members 74, 76 are a mirrored shape relative to the other. In another embodiment, the first and second securing members 74, 76 are not a mirrored shape relative to the other. The first and second securing members 74, 76 of the tongue 70 are positioned on the arm 66 between the first support member 68 and the decorative member 72.

In an embodiment, the decorative member 72 extends from the distal end of the arm 66 opposite the end of the arm 66 connected to the base 60, as shown in FIGS. 5A-5B. Because the first support member 68 provides a gap 78 (FIG. 2B) between adjacent panels 20, the decorative member 72 is configured to provide an aesthetic division or filler within the gap 78 generated by the first support member 68. In the illustrated embodiment, the decorative member 72 includes a pair of lateral projections and a spacer projection that extends from the arm 66 and is substantially linearly aligned therewith. The lateral projections of the decorative member 72 are positioned adjacent to the tongue 70, and the spacer projection extends from the lateral projections in a direction away from the tongue 70. When installed, the lateral projections of the decorative member 72 are positioned within the gap between vertically-adjacent panels 20, and the spacer projection of the decorative member 72 is positioned adjacent to the front surface 32 of those panels 20. In an embodiment, the spacer projection of the decorative member 72 extends beyond the front surface 32 of adjacent panels 20 when installed.

Figure 5D:
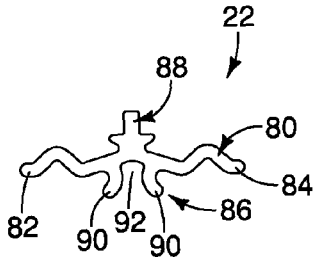
FIG. 5D is a cross-sectional view of the cross spline shown in FIG. 5C.

An embodiment of a cross spline 22 of the wall panel system 10 is illustrated in FIGS. 1 and 5C-5D. In an embodiment, the cross spline 22 includes a tongue 80, a support member 86, and a decorative member 88 forming a single structural member. The illustrated cross spline 22 includes a tongue 80 formed of a first securing member 82 and an opposing second securing member 84. The first and second securing members 82, 84 extend in opposing directions, and each of the first and second securing members 82, 84 is configured to be received within a groove 40 formed into the vertical edge 36 of horizontally-adjacent panels 20. The first and second securing members 82, 84 of the cross spline 22 are generally aligned in opposing directions. In an embodiment, the first and second securing members 82, 84 are linear projections. In another embodiment, the first and second securing member 82, 84 are non-linear projections, wherein the first and second securing members 82, 84 each include at least one bend or curve along their length. The bend or curve in the first and second securing members 82, 84 is configured to ensure that the respective securing member contacts both opposing side walls of the corresponding groove 40. The non-linear shape of the first and second securing members 82, 84 provides opposing contact surfaces on each securing member to contact both side walls of a groove 40 without having to have a precise thickness to ensure contact with both side walls. The non-linear shape and flexibility of the first and second securing members 82, 84 also act similar to an outwardly-biasing spring to positively contact and grip the opposing side walls of the groove 40 into which each is disposed. The first and second securing members 82, 84 of the tongue 80 are positioned between the support member 86 and the decorative member 88.

Figure 5E:
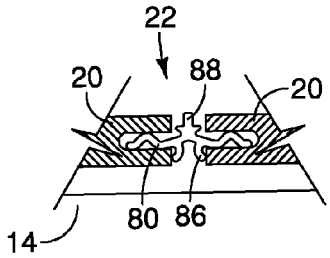
FIG. 5E is a top cross-sectional view of the cross spline shown in FIG. 5C between adjacent panels.

The support member 86 of the cross spline 22 extends rearwardly from the tongue 80, as shown in FIGS. 5C-5E. The support member 86 includes a pair of spaced-apart and opposing projections 90 having a gap 92 therebetween. In an embodiment, each projection 90 of the support member 86 is curved as it extends away from the tongue 80. In another embodiment, each projection 90 extends away from the tongue 80 in a substantially linear manner. As shown in FIG. 5E, the projections 90 are configured to contact adjacent panels 20 to provide a gap therebetween.

In an embodiment, the decorative member 88 extends from the tongue 80 in the direction opposite the support member 86, as shown in FIGS. 5C-5E. In the illustrated embodiment, the decorative member 88 includes a pair of lateral projections and a substantially linear spacer projection that extends from the tongue 80. The lateral projections of the decorative member 88 are positioned adjacent to the tongue 80, and the spacer projection extends from the lateral projections in a direction away from the tongue 80. When installed, the lateral projections of the decorative member 88 are positioned within the gap between horizontally-adjacent panels 20, and the spacer projection of the decorative member 88 is positioned adjacent to the front surface 32 of those panels 20. In an embodiment, the spacer projection of the decorative member 88 extends beyond the front surface 32 of adjacent panels 20 when installed. As shown in FIG. 1, a portion of the decorative member 88 extends longitudinally beyond the edge of the tongue 80 and the support member 86 in both opposing directions. When the cross spline 22 extends between adjacent rails 12, these extensions of the decorative member 88 overlap the second securing member 76 of the rail 12 positioned thereabove as well as the first securing member 74 of the rail 12 positioned therebelow. In an embodiment, this extension of the decorative member 88 of the cross spline 22 contacts a lateral projection of the decorative member 72 of both adjacent rails 12. In an embodiment, the decorative member 88 of the cross spline 22 provides substantially the same visual appearance between adjacent horizontally-aligned panels 20 with respect to the visual appearance the decorative member 72 of the rail 12 provides between adjacent vertically-aligned panels 20.

Figure 6A:
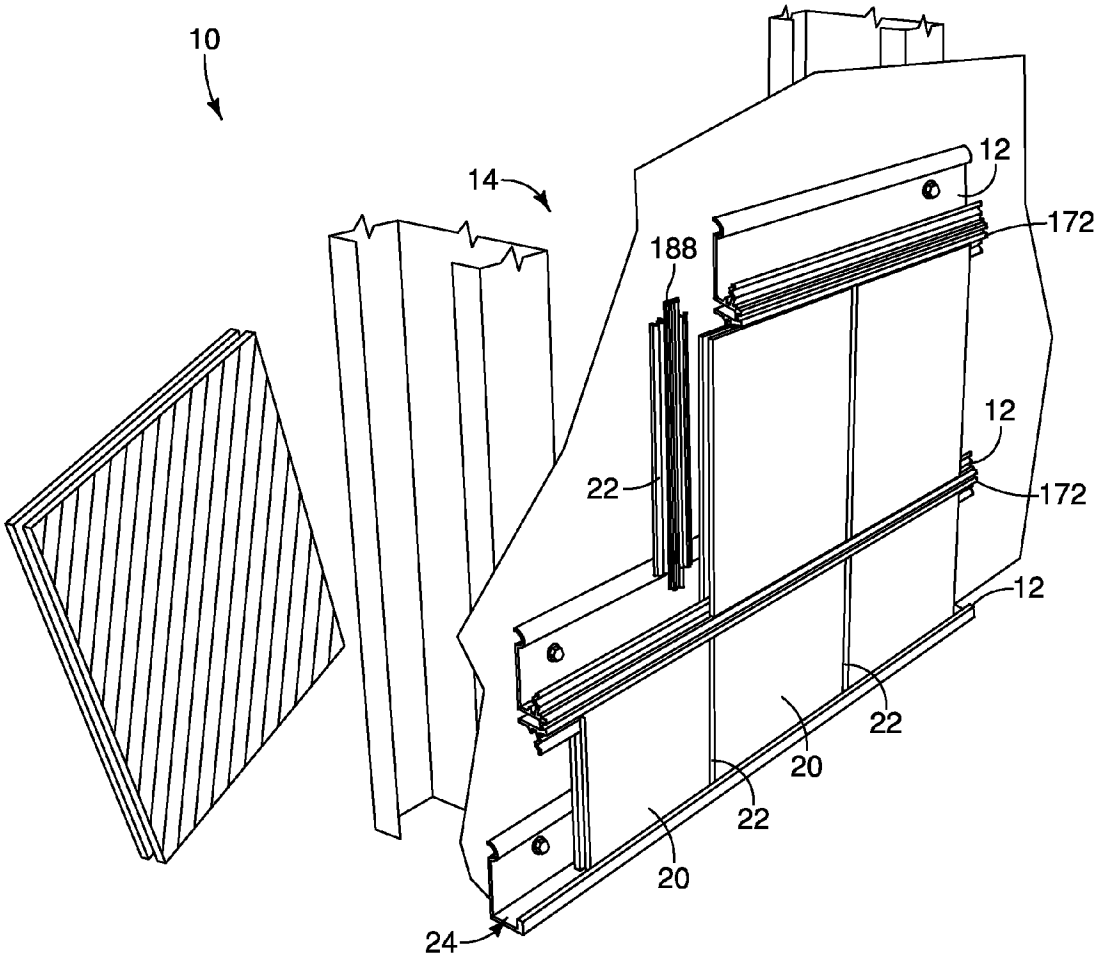
FIG. 6A is another embodiment of a wall panel system.

Another exemplary embodiment of a wall panel system 10 is illustrated in FIGS. 6A-6E. The illustrated wall panel system 10 includes a plurality of horizontally-aligned rails 12, vertically-aligned cross splines 22, panels 20 generally arranged in rows and columns, and a wall support structure 14 to which the rails 12 are attached. The panels 20 illustrated in FIG. 6A are the same panels illustrated in FIG. 1. The rail 12 illustrated in FIGS. 6B-6C and the cross spline 22 illustrated in 6D-6E provide the same structural support as the corresponding rail 12 illustrated in FIGS. 5A-5B and cross spline 22 illustrated in FIGS. 5C-5D, but the different embodiments provide different aesthetics the wall panel system 10 is fully installed. The rail 12 and cross spline 22 described below for the embodiment illustrated in FIGS. 6A-6E will include similar reference numerals for portions of these components that correspond to like portions in the embodiment described above and shown in FIGS. 1 and 5A-5E.

Figure 6B:
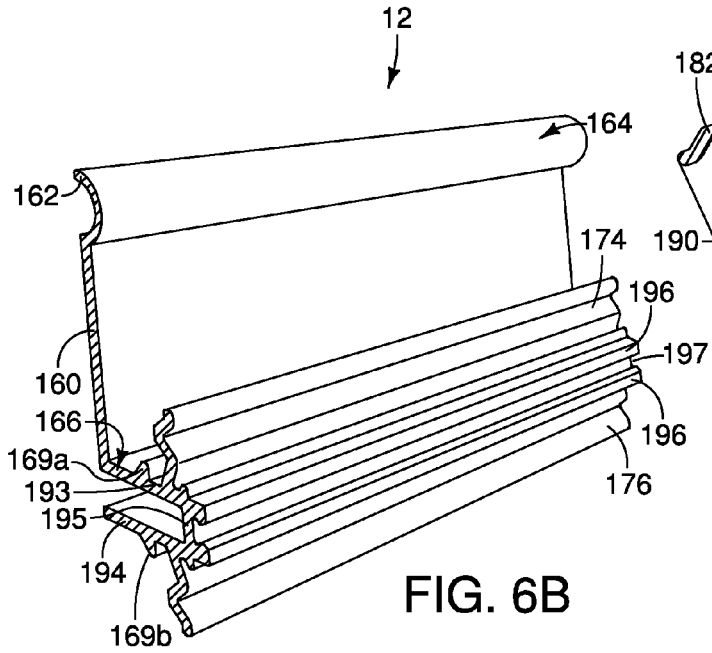
FIG. 6B is a perspective view of the rail shown in FIG. 6A.
Figure 6D:
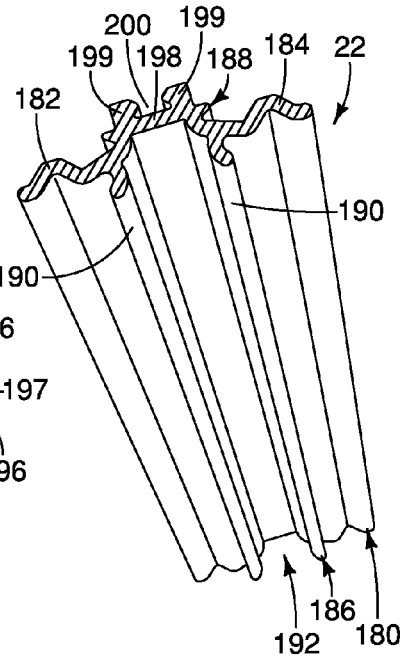
FIG. 6D is a perspective view of the cross spline shown in FIG. 6A.
Figure 6C:
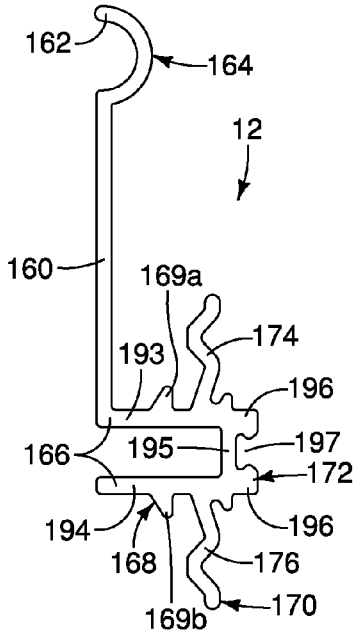
FIG. 6C is a cross-sectional view of the rail shown in FIG. 6B.

FIGS. 6B-6C show another embodiment of a rail 12 for a wall panel system 10. The rail 12 includes a base 160, a buffer 162 extending from one end of the base 160, and an arm 166 extending from the opposing end of the base 160. The base 160 is an elongated, substantially planar member configured to be positioned immediately adjacent to a wall support structure 14 for attachment thereto.

The embodiment of the rail 12 shown in FIGS. 6A-6C also includes a buffer 162 extending from a distal end of the base 160. In the illustrated embodiment, the buffer 162 has a semi-circular cross-sectional shape. In another embodiment, the buffer 162 has a square-like cross-sectional shape. It should be understood by one of ordinary skill in the art that the buffer 162 may have any cross-sectional shape sufficient to contact the panel 20 to maintain at least a portion of the panel 20 in a spaced-apart relationship relative to the wall support structure 14. When installed, the buffer 162 extends away from the wall support structure 14 to provide a contact surface 164 against which the panel 20 abuts when installed, wherein the contact surface 164 thus maintains the panel 20 in a spaced-apart relationship relative to the support structure 14.

An arm 166 extends from the opposing distal end of the base 160 of the rail 12 with respect to the buffer 162, as shown in FIGS. 6A-6B. The arm 166 is a U-shaped member having an upper portion 193, a lower portion 194, and a web portion 195 extending between and connecting the upper and lower portions 193, 194. Each of the portions of the arm 166 is oriented substantially perpendicular relative to the adjacent portion of the arm 166. The arm 166 includes a support member 168, a tongue 170, and a decorative member 172 extending therefrom. The support member 168 includes a first protrusion 169*a* that extends outwardly from the upper portion 193 of the arm 166 and a second protrusion 169*b* that extends outwardly from the lower portion 194 of the arm 166. Each of these protrusions 169*a*, 169*b* of the support member 168 is configured to contact an adjacent panel 20. The support member 168 is positioned adjacent to, but spaced apart from, the intersection between the arm 166 and the base 160.

In an embodiment, the tongue 170 is located along the arm 166 adjacent to the first support member 168 but laterally outward relative to the base 160, as shown in FIGS. 6A-6C. The tongue 170 includes a first securing member 174 extending from the upper portion 193 of the arm 166 and a second securing member 176 extending from the lower portion 194 of the arm 166. The first and second securing members 174, 176 extending from the arm 166 in a manner such that they are generally aligned and spaced apart by approximately the length of the web portion 195 of the arm 166. In an embodiment, the first and second securing members 174, 176 are linear projections extending in opposing directions from the arm 166. In another embodiment, the first and second securing member 174, 176 project from the arm 166 in a non-linear manner, wherein the first and second securing members 174, 176 each include at least one bend or curve along their length as they extend from the arm 166. The non-linear shape and flexibility of the first and second securing members 174, 176 act similarly to an outwardly-biasing spring to positively contact and grip the opposing side walls of the groove 40 into which each is disposed. In an embodiment, the first and second securing members 174, 176 are a mirrored shape relative to the other. In another embodiment, the first and second securing members 174, 176 are not a mirrored shape relative to the other. The first and second securing members 174, 176 of the tongue 170 are positioned on the arm 166 between the support member 168 and the decorative member 172.

In an embodiment, the decorative member 172 extends laterally outward from the web portion 195 of the arm 166, as shown in FIGS. 6A-6C. In the illustrated embodiment, the decorative member 172 includes a pair of lateral projections as well as a longitudinal spacer projection that extend from the arm 166. The lateral projections of the decorative member 172 are positioned adjacent to the tongue 170, and the longitudinal spacer projection extends from the web portion 195 of the arm 166 in a direction away from the tongue 170. In an embodiment, the spacer projection of the decorative member 172 is formed of a pair of spaced-apart extensions 196 forming a channel 197 therebetween. In an embodiment, the extensions 196 are linear members extending from the arm 166. In another embodiment, the extensions 196 are non-linear members extending from the arm 166. In an embodiment, the extensions 196 of the decorative member 172 extend beyond the front surface 32 of adjacent panels 20 when installed. In another embodiment, the extensions 196 of the decorative member 172 are aligned in a substantially planar manner with the front surface 32 of adjacent panels 20 when installed.

Figure 6E:
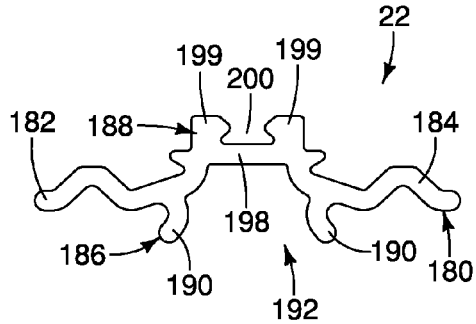
FIG. 6E is a cross-sectional view of the cross spline shown in FIG. 6D.

FIGS. 6D-6E show another embodiment of a cross spline 22 for a wall panel system 10. In an embodiment, the cross spline 22 includes a tongue 180, a support member 186, and a decorative member 188 forming a single structural member. The illustrated tongue 180 includes a first securing member 182 and an opposing second securing member 184, wherein the first and second securing members 182, 184 are connected by a web member 198. The first and second securing members 182, 184 of the cross spline 22 are generally aligned in opposing directions. In an embodiment, the first and second securing members 182, 184 are linear projections. In another embodiment, the first and second securing member 182, 184 are non-linear projections, wherein the first and second securing members 182, 184 each include at least one bend or curve along their length. The first and second securing members 182, 184 of the tongue 180 are positioned between the support member 186 and the decorative member 188.

The support member 186 of the cross spline 22 extends rearwardly from the tongue 180, as shown in FIGS. 6D-6E. The support member 186 includes a pair of spaced-apart and opposing projections 190 having a gap 192 therebetween. In an embodiment, each projection 190 of the support member 186 is curved as it extends away from the tongue 180. In another embodiment, each projection 190 extends away from the tongue 180 in a substantially linear manner.

In an embodiment, the decorative member 188 extends from the tongue 180 in the direction opposite the support member 186, as shown in FIGS. 6D-6E. In the illustrated embodiment, the decorative member 172 includes a pair of lateral projections as well as a longitudinal spacer projection. The lateral projections of the decorative member 188 are positioned adjacent to the tongue 180, and the longitudinal spacer projection extends from the web member 198 in a direction away from the tongue 180. In an embodiment, the spacer projection of the decorative member 188 is formed of a pair of spaced-apart hook members 199 forming a channel 200 therebetween. In an embodiment, the hook members 199 of the decorative member 188 of the cross spline 22 extend beyond the front surface 32 of adjacent panels 20 when installed. In another embodiment, the hook members 199 of the decorative member 188 are aligned in a substantially planar manner with the front surface 32 of adjacent panels 20 when installed. As shown in FIG. 6A, a portion of the decorative member 188 extends longitudinally beyond the edge of the tongue 180 and the support member 186 in both opposing directions. In another embodiment, the decorative member 188 is the same longitudinal length as the tongue 180 and the support member 186 such that there is no extending portion of the decorative member 188.

Figure 7A:
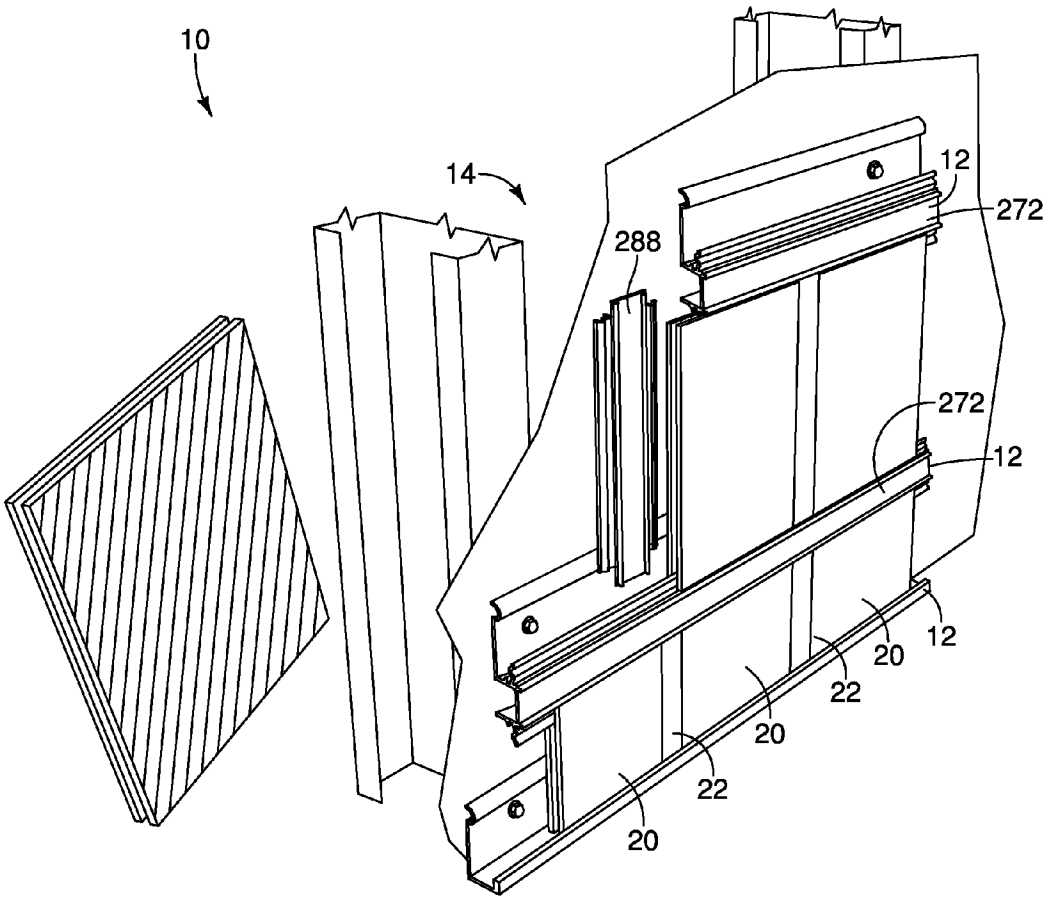
FIG. 7A is yet another embodiment of a wall panel system.

Yet another exemplary embodiment of a wall panel system 10 is illustrated in FIGS. 7A-7E. The illustrated wall panel system 10 includes a plurality of horizontally-aligned rails 12, vertically-aligned cross splines 22, panels 20 generally arranged in rows and columns, and a wall support structure 14 to which the rails 12 are attached. The panels 20 illustrated in FIG. 7A are the same panels illustrated in FIG. 1. The rail 12 illustrated in FIGS. 7B-7C and the cross spline 22 illustrated in 7D-7E provide the same structural support as the corresponding rail 12 illustrated in FIGS. 5A-5B and cross spline 22 illustrated in FIGS. 5C-5D, but the different embodiments provide different aesthetics the wall panel system 10 is fully installed. The rail 12 and cross spline 22 described below for the embodiment illustrated in FIGS. 7A-7E will include similar reference numerals for portions of these components that correspond to like portions in the embodiment described above and shown in FIGS. 1 and 5A-5E.

Figure 7B:
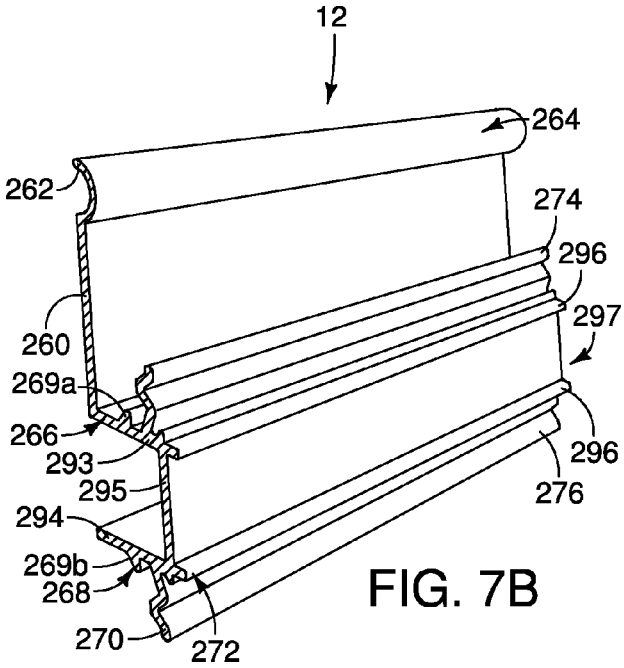
FIG. 7B is a perspective view of the rail shown in FIG. 7A.
Figure 7D:
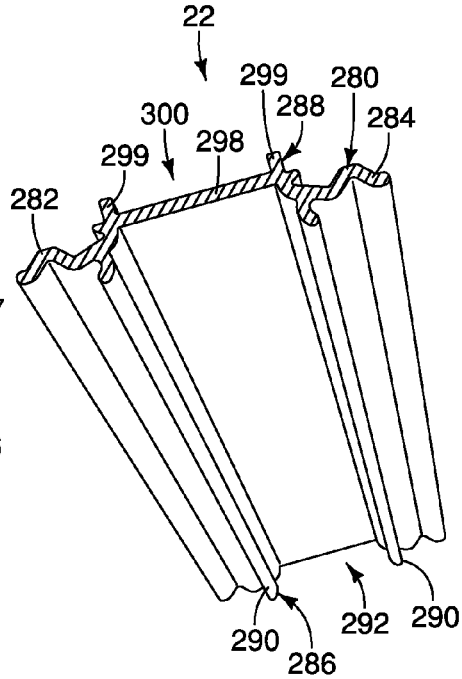
FIG. 7D is a perspective view of the cross spline shown in FIG. 7A.
Figure 7C:
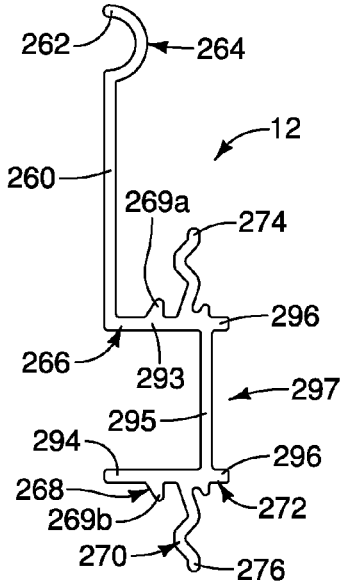
FIG. 7C is a cross-sectional view of the rail shown in FIG. 7B.

FIGS. 7B-7C show another embodiment of a rail 12 for a wall panel system 10. The rail 12 includes a base 260, a buffer 262 extending from one end of the base 260, and an arm 266 extending from the opposing end of the base 260. The base 260 is an elongated, substantially planar member configured to be positioned immediately adjacent to a wall support structure 14 for attachment thereto.

The embodiment of the rail 12 shown in FIGS. 7A-7C also includes a buffer 262 extending from a distal end of the base 260. In the illustrated embodiment, the buffer 262 has a semi-circular cross-sectional shape. In another embodiment, the buffer 262 has a square-like cross-sectional shape. It should be understood by one of ordinary skill in the art that the buffer 262 may have any cross-sectional shape sufficient to contact the panel 20 to maintain at least a portion of the panel 20 in a spaced-apart relationship relative to the wall support structure 14. When installed, the buffer 262 extends away from the wall support structure 14 to provide a contact surface 264 against which the panel 20 abuts when installed, wherein the contact surface 264 thus maintains the panel 20 in a spaced-apart relationship relative to the support structure 14.

An arm 266 extends from the opposing distal end of the base 260 of the rail 12 with respect to the buffer 262, as shown in FIGS. 7A-7B. The arm 266 is a U-shaped member having an upper portion 293, a lower portion 294, and a web portion 295 extending between and connecting the upper and lower portions 293, 294. Each of the portions of the arm 266 is oriented substantially perpendicular relative to the adjacent portion of the arm 266. The arm 266 includes a support member 268, a tongue 270, and a decorative member 272 extending therefrom. The support member 268 includes a first protrusion 269*a* that extends outwardly from the upper portion 293 of the arm 266 and a second protrusion 269*b* that extends outwardly from the lower portion 294 of the arm 266. Each of these protrusions 269*a*, 269*b* of the support member 268 is configured to contact an adjacent panel 20. The support member 268 is positioned adjacent to, but spaced apart from, the intersection between the arm 266 and the base 260.

In an embodiment, the tongue 270 is located along the arm 266 adjacent to the first support member 268 but laterally outward relative to the base 260, as shown in FIGS. 7A-7C. The tongue 270 includes a first securing member 274 extending from the upper portion 193 of the arm 266 and a second securing member 276 extending from the lower portion 294 of the arm 266. The first and second securing members 274, 276 extending from the arm 266 in a manner such that they are generally aligned and spaced apart by approximately the length of the web portion 295 of the arm 266. In an embodiment, the first and second securing members 274, 276 are linear projections extending in opposing directions from the arm 266. In another embodiment, the first and second securing member 274, 276 project from the arm 266 in a non-linear manner, wherein the first and second securing members 274, 276 each include at least one bend or curve along their length as they extend from the arm 266. In an embodiment, the first and second securing members 274, 276 are a mirrored shape relative to the other. In another embodiment, the first and second securing members 274, 276 are not a mirrored shape relative to the other. The first and second securing members 274, 276 of the tongue 270 are positioned on the arm 266 between the support member 268 and the decorative member 272.

In an embodiment, the decorative member 272 extends laterally outward from the web portion 295 of the arm 266, as shown in FIGS. 7A-7C. In the illustrated embodiment, the decorative member 272 includes a pair of lateral projections as well as a longitudinal spacer projection that extend from the arm 266. The lateral projections of the decorative member 272 are positioned adjacent to the tongue 270, and the longitudinal spacer projection extends from the web portion 295 of the arm 266 in a direction away from the tongue 270. In an embodiment, the spacer projection of the decorative member 272 is formed of a pair of spaced-apart extensions 296 forming a channel 297 therebetween. The channel 297 of the rail 12 illustrated in FIGS. 7A-7C is significantly wider than the channel 197 illustrated in FIGS. 6A-6C. In an embodiment, the extensions 296 are linear members extending from the arm 266. In another embodiment, the extensions 296 are non-linear members extending from the arm 266. In an embodiment, the extensions 296 of the decorative member 272 extend beyond the front surface 32 of adjacent panels 20 when installed. In another embodiment, the extensions 296 of the decorative member 272 are aligned in a substantially planar manner with the front surface 32 of adjacent panels 20 when installed.

Figure 7E:
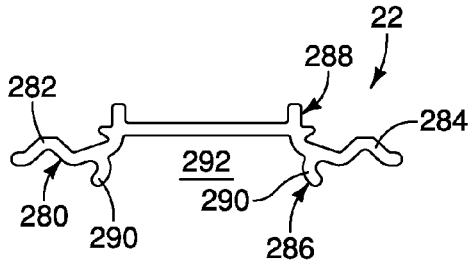
FIG. 7E is a cross-sectional view of the cross spline shown in FIG. 7D.

FIGS. 7D-7E show another embodiment of a cross spline 22 for a wall panel system 10. In an embodiment, the cross spline 22 includes a tongue 280, a support member 286, and a decorative member 288 forming a single structural member. The illustrated tongue 280 includes a first securing member 282 and an opposing second securing member 284, wherein the first and second securing members 282, 284 are connected by a web member 298. The first and second securing members 282, 284 of the cross spline 22 are generally aligned in opposing directions. In an embodiment, the first and second securing members 282, 284 are linear projections. In another embodiment, the first and second securing member 282, 284 are non-linear projections, wherein the first and second securing members 282, 284 each include at least one bend or curve along their length. The first and second securing members 282, 284 of the tongue 280 are positioned between the support member 286 and the decorative member 288.

The support member 286 of the cross spline 22 extends rearwardly from the tongue 280, as shown in FIGS. 7D-7E. The support member 286 includes a pair of spaced-apart and opposing projections 290 having a gap 292 therebetween. In an embodiment, each projection 290 of the support member 286 is curved as it extends away from the tongue 280. In another embodiment, each projection 290 extends away from the tongue 280 in a substantially linear manner.

In an embodiment, the decorative member 288 extends from the tongue 280 in the direction opposite the support member 286, as shown in FIGS. 7D-7E. In the illustrated embodiment, the decorative member 272 includes a pair of lateral projections as well as a longitudinal spacer projection. The lateral projections of the decorative member 288 are positioned adjacent to the tongue 280, and the longitudinal spacer projection extends from the web member 298 in a direction away from the tongue 280. In an embodiment, the spacer projection of the decorative member 288 is formed of a pair of spaced-apart extensions 299 forming a channel 300 therebetween. The channel 300 of the cross spline 22 illustrated in FIGS. 7D-7E is significantly wider than the channel 200 illustrated in FIGS. 6D-6E. In an embodiment, the extensions 299 are linear members extending from the tongue 280. In another embodiment, the extensions 299 are non-linear members extending from the tongue 280. In an embodiment, the extensions 299 of the decorative member 288 of the cross spline 22 extend beyond the front surface 32 of adjacent panels 20 when installed. In another embodiment, the hook members 299 of the decorative member 288 are aligned in a substantially planar manner with the front surface 32 of adjacent panels 20 when installed. As shown in FIG. 7A, a portion of the decorative member 288 extends longitudinally beyond the edge of the tongue 280 and the support member 286 in both opposing directions. In another embodiment, the decorative member 288 is the same longitudinal length as the tongue 280 and the support member 286 such that there is no extending portion of the decorative member 288.

Figure 8A:
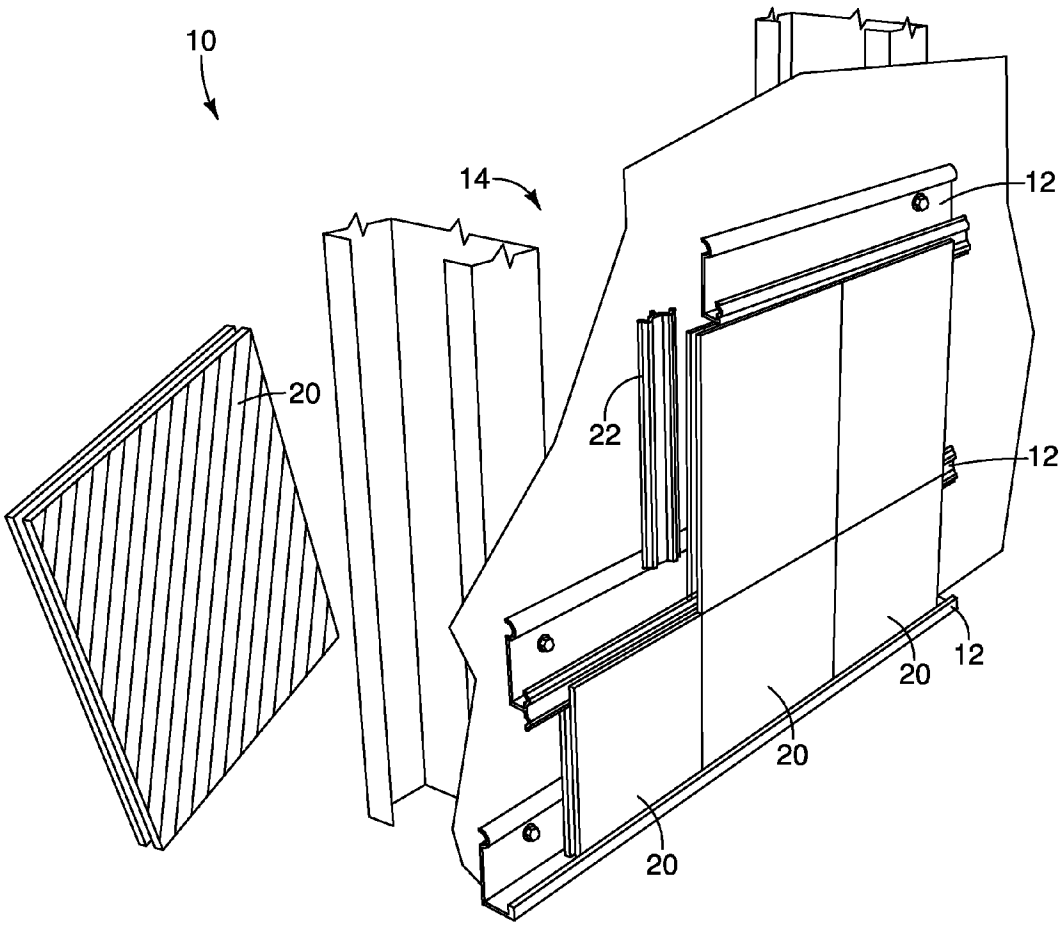
FIG. 8A is a further embodiment of a wall panel system.

A further exemplary embodiment of a wall panel system 10 is illustrated in FIGS. 8A-8E. The illustrated wall panel system 10 includes a plurality of horizontally-aligned rails 12, vertically-aligned cross splines 22, panels 20 generally arranged in rows and columns, and a wall support structure 14 to which the rails 12 are attached. The panels 20 illustrated in FIG. 8A are the same panels illustrated in FIG. 1. The rail 12 illustrated in FIGS. 8B-8C and the cross spline 22 illustrated in 8D-8E provide the same structural support as the corresponding rail 12 illustrated in FIGS. 5A-5B and cross spline 22 illustrated in FIGS. 5C-5D, but the different embodiments provide different aesthetics the wall panel system 10 is fully installed. The rail 12 and cross spline 22 described below for the embodiment illustrated in FIGS. 8A-8E will include similar reference numerals for portions of these components that correspond to like portions in the embodiment described above and shown in FIGS. 1 and 5A-5E.

Figure 8B:
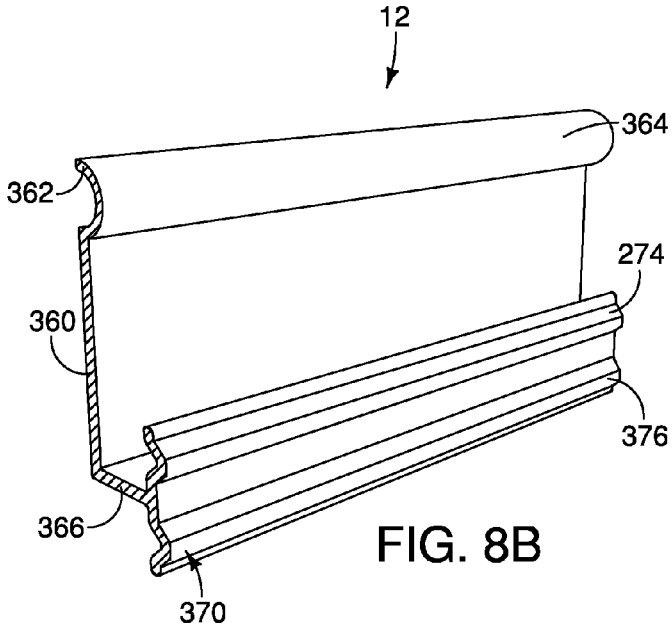
FIG. 8B is a perspective view of the rail shown in FIG. 8A.
Figure 8D:
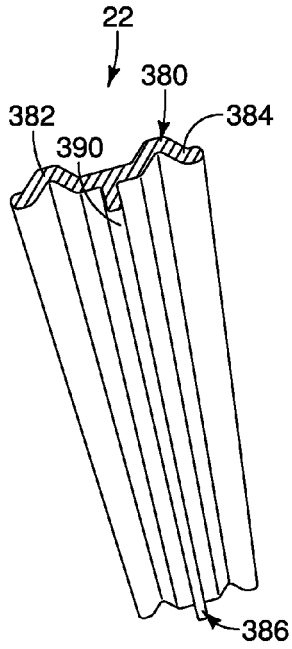
FIG. 8D is a perspective view of the cross spline shown in FIG. 8A.
Figure 8C:
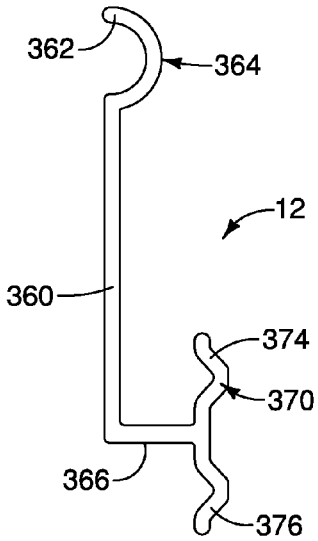
FIG. 8C is a cross-sectional view of the rail shown in FIG. 8B.

FIGS. 8B-8C illustrate another embodiment of a rail 12 for a wall panel system 10. The rail 12 includes a base 360, a buffer 362 extending from one end of the base 360, and an arm 366 extending from the opposing end of the base 360. The base 360 is an elongated, substantially planar member configured to be positioned immediately adjacent to a wall support structure 14 for attachment thereto.

The embodiment of the rail 12 shown in FIGS. 8A-8C also includes a buffer 362 extending from a distal end of the base 360. In the illustrated embodiment, the buffer 362 has a semi-circular cross-sectional shape. In another embodiment, the buffer 362 has a square-like cross-sectional shape. It should be understood by one of ordinary skill in the art that the buffer 362 may have any cross-sectional shape sufficient to contact the panel 20 to maintain at least a portion of the panel 20 in a spaced-apart relationship relative to the wall support structure 14. When installed, the buffer 362 extends away from the wall support structure 14 to provide a contact surface 364 against which the panel 20 abuts when installed, wherein the contact surface 364 thus maintains the panel 20 in a spaced-apart relationship relative to the support structure 14.

An arm 366 extends from the opposing distal end of the base 360 of the rail 12 with respect to the buffer 362, as shown in FIGS. 8B-8C. The arm 366 is oriented substantially perpendicular with respect to the base 360. The arm 366 extends the length of the rail 12 and provides support for a panel 20 positioned above the arm 366 as well as engaging the panel 20 positioned below the arm 366 when the rail 12 is installed in a substantially horizontal manner. The arm 366 includes a tongue 370 extending therefrom.

In an embodiment, the tongue 370 is positioned the arm 66 laterally outward relative to the intersection between the arm 366 and the base 360, as shown in FIGS. 8B-8C. The tongue 370 extends in opposing directions from the arm 366 to provide a first securing member 374 and a second securing member 376. The first and second securing members 374, 376 extending from the arm 66 in a manner such that they are generally aligned and spaced apart from the base 360. In an embodiment, the first and second securing members 374, 376 are linear projections extending in opposing directions from the arm 366. In another embodiment, the first and second securing member 374, 376 project from the arm 366 in a non-linear manner, wherein the first and second securing members 374, 376 each include at least one bend or curve along the length as they extend from the arm 366. In an embodiment, the first and second securing members 374, 76 are a mirrored shape relative to the other. In another embodiment, the first and second securing members 374, 376 are not a mirrored shape relative to the other.

The embodiment of the rail 12 illustrated in FIGS. 8A-8C does not include a support member for providing a gap between adjacent panels 20 or a decorative member that provides an aesthetic element between adjacent panels. Without the support member on the arm 366 of the rail 12, the tongue 370 is received within the corresponding panels 20 such that the edge of each adjacent panel 20 contacts the arm 366 of the rail 20. Thus, the gap between vertically-adjacent panels 20 is substantially equivalent to the thickness of the arm 366. Also, without a decorative member, the visible division between vertically-adjacent panels 20 is the gap generated by the thickness of the arm 366 of the rail.

Figure 8E:
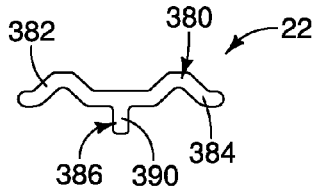
FIG. 8E is a cross-sectional view of the cross spline shown in FIG. 8D.

FIGS. 8D-8E show another embodiment of a cross spline 22 for a wall panel system 10. In an embodiment, the cross spline 22 includes a tongue 380 and a support member 386 that form a single structural member. The illustrated tongue 380 includes a first securing member 382 and an opposing second securing member 384. The first and second securing members 382, 384 of the cross spline 22 are generally aligned in opposing directions. In an embodiment, the first and second securing members 382, 384 are linear projections. In another embodiment, the first and second securing member 382, 384 are non-linear projections, wherein the first and second securing members 382, 384 each include at least one bend or curve along their length.

The support member 386 of the cross spline 22 extends rearwardly from the tongue 380, as shown in FIGS. 8D-8E. In an embodiment, the support member 386 includes a single projection 390. In another embodiment, the support member 386 is formed as a plurality of spaced-apart projections extending from the tongue 380. In the illustrated embodiment, the projection 390 extends away from the tongue 380 in a substantially linear manner. The projection 390 is configured to provide a gap between horizontally-adjacent panels 20. The corresponding edges of the adjacent panels 20 contact the projection 390 such that the gap between the panels 20 is substantially the same distance as the thickness of the projection 390.

The embodiment of the cross spline 22 illustrated in FIGS. 8D-8E does not include a decorative member that provides an aesthetic element between horizontally-adjacent panels 20. Without a decorative member, the visible division between horizontally-adjacent panels 20 is the gap generated by the thickness of the support member 386. In addition, because the cross spline 22 does not include a decorative member, the support member 386 and the tongue 380 provide the entire longitudinal length of the cross spline 22 without an extension of a decorative member extending beyond either end of the support member 386 and tongue 380. It should be understood by one of ordinary skill in the art that the cross spline 22 in any of the previously discussed embodiments may include a decorative member that extends longitudinally beyond the support member and tongue or the decorative member may terminate in a relatively co-planar manner relative to the support member and tongue at each distal end of the cross spline 22.

Figure 9B:
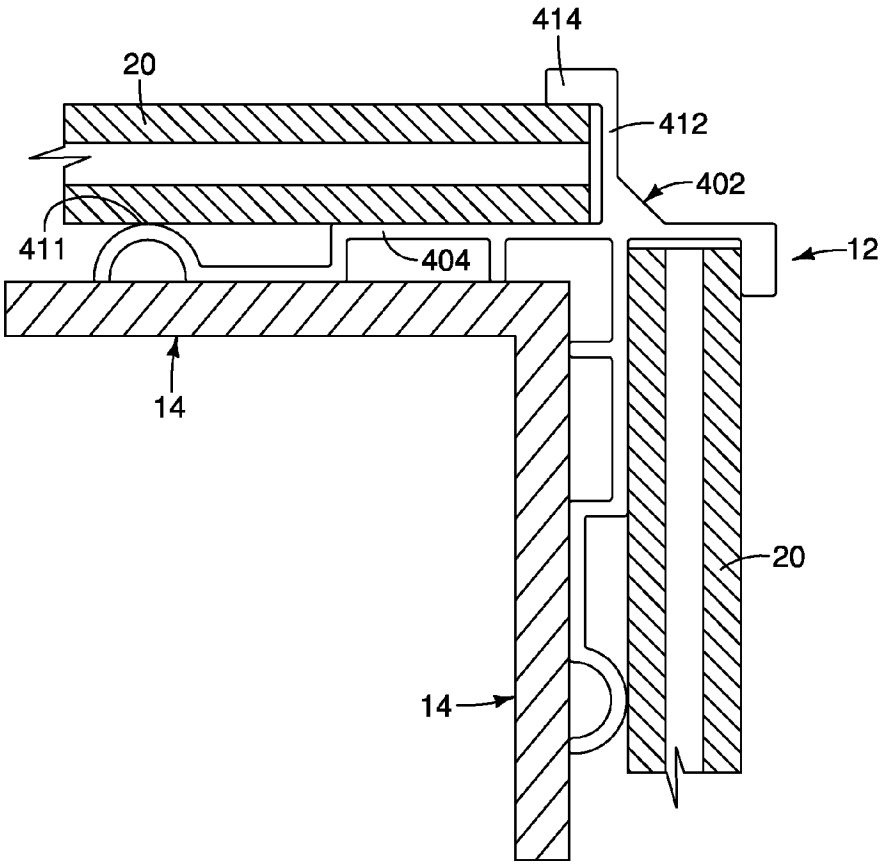
FIG. 9B is the corner rail shown in FIG. 9A operatively connected to adjacent wall support structures.
Figure 9A:
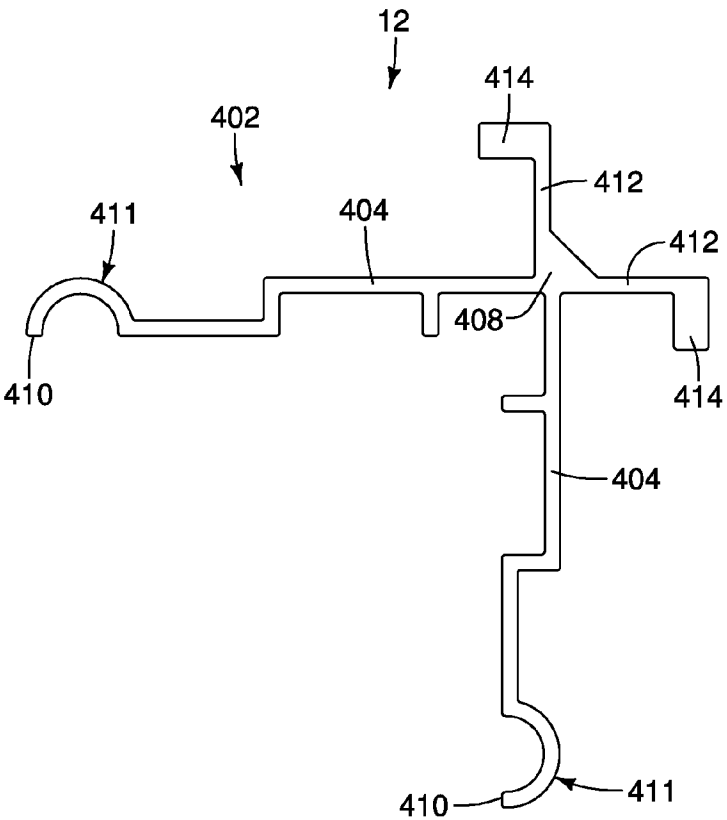
FIG. 9A is an embodiment of a corner rail.

While the wall panel system 10 illustrated in FIGS. 1, 6A, 7A, and 8A are shown as extending adjacent to a single wall support structure 14, it should be understood by one of ordinary skill in the art that the wall panel system 10 may also be installed on adjacent wall support structures 14. In particular, the wall panel system 10 can be installed on two or more walls that form an angle therebetween. FIGS. 9A-9B illustrate an exemplary embodiment of a corner rail 402 that is configured to provide an aesthetic terminal edge to two adjacent wall support structures 14 while also providing a transition therebetween. The corner rail 402 is illustrated as being configured to provide a transition for adjacent wall support structures 14 oriented at a right angle relative to each other, but it should be understood by one of ordinary skill in the art that the corner rail 402 can be configured to provide a transition to adjacent wall support structures 14 oriented at any angle relative to each other.

In an embodiment, the corner rail 402 includes a first base 404 and a second base 406 extending from the first base 404 at a right angle relative to an intersection 408 therebetween, as shown in FIGS. 9A-9B. The first and second bases 404, 406 are configured to be positioned adjacent to a wall support structure 14. A buffer 410 extends from the end of each of the first and second bases 404, 406 opposite the intersection 408. The buffer 410 provides a contact surface 411 that contacts a rear surface 34 of a panel 20. In an embodiment, the surface of the base 404, 406 directed away from the wall support structure 14 is substantially coplanar with respect to the contact surface 411. In another embodiment, the surface of the base 404, 406 directed away from the wall support structure 14 is generally parallel with respect to the contact surface 411. A pair of caps 412 extend from the intersection 408 at an angle relative to a corresponding base 404, 406. In an embodiment, each cap 412 extends from the intersection 408 at a right angle relative to a corresponding base 404, 406. At the end of each cap 412, opposite the end connected to the intersection 408, a cover 414 extends from the cap 412 to form a substantially U-shaped member along with a cap 412 and base 404, 406. The U-shaped portions of the corner rail 402 are configured to receive adjacent panels 20 to form an intersection between two angled portions of a wall support structure 14.

To install an embodiment of the wall panel system 10 on a wall support structure 14, at least one edge rail 24 is positioned at the intersection between the floor 26 and the wall, which may include drywall 18. The edge rail 24 is positioned such that the base 42 is adjacent to the drywall 18 and the cap 44 is adjacent to the floor 26. The edge rail 24 is attached to the wall support structure 14 by a plurality of mechanical fasteners. It should be understand that the edge rail 24 should be securely attached to the wall support structure 14, but the edge rail 24 can also be removed therefrom. This edge rail 24 is configured to provide the lower alignment for a horizontal row of panels 20.

Once the edge rail 24 has been secured to the wall support structure 14, an adjacent rail 12 is positioned in a substantially parallel and spaced-apart orientation with respect to the edge rail 24. The adjacent rail 12 is positioned such that the lower horizontal edge 38 of a panel 20 is positioned immediately adjacent to the upwardly-directed surface of the cap 44, wherein the rear surface 34 of the panel 20 contacts the first contact surface 50 of the rail 12 and the front surface 36 of the panel 20 contacts the second contact surface 52 of the rail 12, as shown in FIGS. 2A-2B. Typically, the panel 20 is positioned such that the lower horizontal edge 38 of the panel 20 contacts the cap 44 such that the rail 12 supports the panel 20 from below and the first and second contact surfaces 52 of the rail 12 secure the bottom portion of the panel 20 and prevent significant movement thereof. The rail 12 is spaced from the edge rail 24 a distance sufficient to allow the second securing member 76 of the tongue 70 to be inserted into the groove 40 formed into the upper horizontal edge 38 of the panel 20 and the support member 68 to contact the same upper horizontal edge 38 of the panel 20. The rail 12 is then secured to the wall support structure 14 by a plurality of mechanical fastening means.

Having an end rail 24 and adjacent rail 12 secured the wall support structure 14, a panel 20 can be positioned therebetween and slid along both rails 12, 24 to a position adjacent to a distal end of thereof. A second panel 20 is then positioned between the end rail 24 and the adjacent rail 12 and slid to a position adjacent to the first panel 20. A cross spline 22 is inserted between the first and second panels such that the first securing member 182 is inserted into the groove 40 formed into the vertical edge 36 of the first panel 20 that is directed toward the second panel, and the second securing member 184 is inserted into the groove 40 formed into the vertical edge 36 of the second panel 20 that is directed toward the first panel. The first and second panels 20 are then pushed together until the support member 86 contacts the corresponding vertical edges 36 of the first and second panels 20. The cross spline 22 is oriented such that the support member 86 is directed toward the wall support structure 14 and the decorative member 88 (if it includes such) is directed away from the wall support structure 14. When assembled, the cross spline 22 is oriented transversely with respect to, or normal to, the adjacent rails 12. Additional panels, if necessary, are then slid between the end rail 24 and the rail 12 in a similar manner with a cross spline 22 positioned between each panel 20 in a like manner until the first row of panels 20 is completed. If more than one row of panels 20 is required or desired, these same steps are followed to add additional rows in a parallel manner to the first row. In an embodiment, the panels of each row are also aligned vertically into columns. In another embodiment, the panels of each adjacent row can be aligned such that the panels form a non-parallel pattern in the vertical direction. Once all rows of panels are in place, the side edges as well as the upper edge of the wall panel system 10 can be capped with an end rail 12 or other capping member to provide an aesthetic boundary on each edge.

In another embodiment, the end rail 24 and at least one other rail 12 can be vertically-aligned such that the panels 20 are positioned between the rails to form a column.

While preferred embodiments of the present invention have been described, it should be understood that the present invention is not so limited and modifications may be made without departing from the present invention. The scope of the present invention is defined by the appended claims, and all devices, processes, and methods that come within the meaning of the claims, either literally or by equivalence, are intended to be embraced therein.

What is claimed is:

1. A wall panel system comprising:

at least two rails, wherein said rails are aligned in a substantially parallel manner;

at least two panels, wherein each of said panels includes a front surface, a rear surface, a peripheral edge extending between said front and rear surfaces, each of said at least two panels being positioned adjacent to another panel, and each of said at least two panels extending between two of said at least two rails that are positioned adjacent to each other; and at least one cross spline, wherein each cross spline is positioned between a pair of adjacent panels, said cross spline being oriented in a substantially normal manner relative to said adjacent rails;

wherein each panel includes a continuous groove formed into said peripheral edge of said panel, and wherein said adjacent rails and at least one cross spline engage said groove;

wherein each of said at least two rails includes a base, a buffer extending from one distal end of said base, an arm extending from an opposing distal end of said base, said arm extending from said base at an angle therebetween.

2. The wall panel system of claim 1, wherein said peripheral edge includes a pair of opposing horizontal edges and a pair of opposing vertical edges, and said continuous groove is formed into each of said horizontal edges and each of said vertical edges.

3. The wall panel system of claim 1, wherein at least one rail includes a tongue that is receivable within said groove said adjacent panels.

4. The wall panel system of claim 3, wherein said tongue includes a first securing member and an opposing second securing member, at least one of said first securing member and said second securing member is receivable within said groove of both of said adjacent panels.

5. The wall panel system of claim 3, wherein said tongue is non-linear.

6. The wall panel system of claim 1, wherein said cross spline includes a decorative member positioned between adjacent panels.

7. The wall panel system of claim 1, wherein said arm includes a support member, a tongue, and a decorative member, said tongue being disposed between said support member and said decorative member, and said support member being disposed adjacent to said base.

* * * * *